US009062393B2

(12) United States Patent
Ito et al.

(10) Patent No.: US 9,062,393 B2
(45) Date of Patent: Jun. 23, 2015

(54) MULTILAYER COMPOSITE FIBER

(75) Inventors: Akira Ito, Mie (JP); Satoshi Nagai, Mie (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 93 days.

(21) Appl. No.: 12/994,588

(22) PCT Filed: May 26, 2009

(86) PCT No.: PCT/JP2009/059612

§ 371 (c)(1),
(2), (4) Date: Mar. 21, 2011

(87) PCT Pub. No.: WO2009/145193

PCT Pub. Date: Dec. 3, 2009

(65) Prior Publication Data

US 2011/0171868 A1 Jul. 14, 2011

(30) Foreign Application Priority Data

May 29, 2008 (JP) ..... 2008-140418

(51) Int. Cl.

| | |
|---|---|
| ***D04H 1/54*** | (2012.01) |
| ***D01F 6/62*** | (2006.01) |
| ***D04H 3/14*** | (2012.01) |
| ***D01F 8/14*** | (2006.01) |
| ***D01F 8/16*** | (2006.01) |
| ***D04H 1/541*** | (2012.01) |
| ***D04H 1/559*** | (2012.01) |
| ***D04H 13/00*** | (2006.01) |

(52) U.S. Cl.
CPC ..... *D01F 8/14* (2013.01); *Y10T 428/2913* (2015.01); *Y10T 428/2933* (2015.01); *D01F 8/16* (2013.01); *D04H 1/541* (2013.01); *D04H 1/559* (2013.01); *D04H 13/007* (2013.01)

(58) Field of Classification Search
CPC ..... C08L 67/04; D04H 1/541; D04H 1/559; D04H 13/007; Y10Y 428/2913; Y10Y 428/2929; Y10Y 428/2973; Y10Y 428/2933
USPC ..... 442/361, 199–202, 311; 428/364, 428/373–374
See application file for complete search history.

(56) References Cited

U.S. PATENT DOCUMENTS

| | | | | |
|---|---|---|---|---|
| 3,418,278 | A | 12/1968 | Pregaglia et al. | |
| 5,079,330 | A * | 1/1992 | Makabe et al. | 528/87 |
| 5,344,911 | A * | 9/1994 | Yamamoto et al. | 528/241 |
| 5,616,736 | A | 4/1997 | Thigpen | |
| 5,952,410 | A * | 9/1999 | Yokoyama et al. | 524/210 |
| 6,441,267 | B1 | 8/2002 | Dugan | |
| 6,506,873 | B1 | 1/2003 | Ryan et al. | |
| 6,953,622 | B2 * | 10/2005 | Tsai et al. | 428/373 |
| 2009/0068463 | A1 | 3/2009 | Mochizuki et al. | |

FOREIGN PATENT DOCUMENTS

| | | |
|---|---|---|
| EP | 1 985 737 | 10/2008 |
| JP | 7-133511 | 5/1995 |
| JP | 8-144128 | 6/1996 |
| JP | 08144128 A * | 6/1996 |

OTHER PUBLICATIONS

Raghavendra Hedge, Bicomponent Fibers, Apr. 15, 2004, www.engr.utk.edu/mse/Textiles/Bicomponent%20fibers.htm.*
European Search Report for Application No. 09754701.2 issued Jun. 8, 2011.
Office Action issued on Apr. 13, 2015 in corresponding European Patent ApplicationNo. 09754701.2.

* cited by examiner

*Primary Examiner* — Jennifer Chriss
*Assistant Examiner* — Frank Vineis
(74) *Attorney, Agent, or Firm* — Morgan, Lewis & Bockius LLP

(57) ABSTRACT

The present invention has an object of providing a novel multilayer composite fiber using polyacetal mainly derived from methanol, which is a petroleum-independent raw material, and having a low environmental load, and also providing a nonwoven fabric obtained by thermally bonding such fibers. According to the present invention, a multilayer composite fiber comprising a resin containing polylactic acid as a main component and a resin containing polyacetal as a main component, in which the components both form continuous layers in an axial direction of the fiber, and also a nonwoven fabric obtained by thermally bonding such fibers, can be provided.

3 Claims, No Drawings

MULTILAYER COMPOSITE FIBER

TECHNICAL FIELD

The present invention relates to a composite fiber in which a resin containing polylactic acid as a main component is used as a core and a resin containing polyacetal as a main component is used as a sheath, the resin containing polyacetal as a main component having a specific difference in the melting point from the resin containing polylactic acid as a main component, and also relates to a nonwoven fabric obtained by processing such composite fibers with thermal bonding.

BACKGROUND ART

In light of the recent global environmental problems, it is a target of attention to use biodegradable (microorganism-degradable or naturally degradable) materials in order to prevent environmental pollution caused by industrial waste. Recently, voluntary restraint of $CO_2$ emissions is strongly demanded in order to deal with the exhaustion of earth resources and the global warming In such a situation, naturally occurring materials as opposed to petroleum-derived materials, and materials which require a small amount of heat or emit a small amount of $CO_2$ when being incinerated, are paid attention to.

It is conventionally known that polymers having an aliphatic ester structure are biodegradable. Representative examples of such polymers include poly-3-hydroxybutyrate (PHB) produced by microorganisms, polycaprolactone (PCL) which is a synthetic polymer, polybutylene succinate (PBS) or polybutylene succinate adipate (PBSA) each containing succinic acid and butanediol as main components, polyester carbonate, polylactic acid (PLA) obtained from L-lactic acid and/or D-lactic acid produced by fermentation as a main starting material, and the like. Among these, PLA, for example, is a naturally occurring material.

These polymers having an aliphatic ester structure, except for PLA, generally have properties similar to those of polyethylene and have good moldability and biodegradability. However, such polymers are not sufficiently strong in a field requiring rigidity or in a field requiring tensile strength. The rigidity of these polymers may be improved using a filler such as talc or the like or using a nanocomposite forming technology. However, there are problems including reduction of fluidity, and improvement on this point has been desired. Regarding PLA, improvement in thermal resistance and toughness has been strongly desired.

Conventionally, there have been several studies by which a core-sheath composite fiber is formed of a biodegradable material and is used as a raw cotton of a thermally bonded nonwoven fabric. For example, Patent Documents 1 and 2 disclose using biodegradable polymers having different melting points as thermoplastic biodegradable fibers for a core and a sheath. Patent Document 3 discloses using a high melting point L-polylactic acid for a core and a copolymer of L-polylactic acid and D-polylactic acid for a sheath. Patent Document 4 discloses a composite fiber in which at least one of the components of a core and a sheath is a biodegradable polymer. The components are different in the melting point by 20 to 80° C., and the melting point distribution of the components is sharp. Patent Document 5 discloses an interior finishing material obtained from a composite fiber, which is formed of polylactic acid covered with another thermoplastic resin.

Patent Document 1: Japanese Laid-Open Patent Publication No. H7-133511

Patent Document 2: Japanese Laid-Open Patent Publication No. H8-260320

Patent Document 3: Japanese Patent No. 3355026

Patent Document 4: Japanese Laid-Open Patent Publication No. 2006-97148

Patent Document 5: Japanese Laid-Open Patent Publication No. 2008-57095

DISCLOSURE OF THE INVENTION

However, when a biodegradable polymer is substantially used even for a sheath, the fiber is easily biodegradable depending on the environment in which the fiber is used. It is concerned that this causes a problem that when the fiber is hydrolyzed, the strength thereof is reduced. In addition, when a low melting point biodegradable polymer or even a thermoplastic resin is used, the processability is improved but the heat resistance may undesirably be reduced at a point of bonding. The present invention has an object of providing a novel multilayer composite fiber which uses a type of polyacetal having a specific melting point, among types of polyacetal which are of aliphatic ether type or contain aliphatic ether as a main component, are mainly derived from methanol that is a petroleum-independent raw material, and are considered to have a low environmental load, and also an object of providing a nonwoven fabric obtained by thermally bonding such multilayer composite fibers.

As a result of active studies for solving the above-described problems, the present inventors have overcome the problems and completed the present invention substantially by using, for a core, a resin containing polylactic acid as a main component and using, for a sheath, a resin containing a specific type of polyacetal as a main component.

The present invention encompasses the following embodiments.

(1) A multilayer composite fiber, comprising a resin containing polylactic acid as a main component and a resin containing polyacetal as a main component, wherein the components both form continuous layers in an axial direction of the fiber, and the resin containing polyacetal as a main component has a melting point which is lower by 10 to 20° C. than the melting point of the resin containing polylactic acid as a main component;

(2) The multilayer composite fiber according to (1) above, wherein the resin containing polylactic acid as a main component is used as a core, and the resin containing polyacetal as a main component is used as a sheath;

(3) The multilayer composite fiber according to (1) or (2) above, wherein the polyacetal is a copolymer of 100 parts by weight of trioxane and 5 to 20 parts by weight of one or at least two types of cyclic formal and/or cyclic ether;

(4) A nonwoven fabric obtained by thermal bonding of the multilayer composite fibers according to any one of (1) through (3) above; and (5) A nonwoven fabric obtained by mixing the multilayer composite fiber according to any one of (1) through (3) above with a fiber comprising a resin containing polylactic acid as a main component and/or a resin containing polyacetal as a main component, and then thermally bonding the fibers.

Polyacetal has high affinity with aliphatic polyester. Especially when polyacetal is put into contact with aliphatic polyester in a melted state, the interface can have a relatively high adhesion strength. For the present invention, it is important to select, as a sheath component, polyacetal which has high affinity especially with an aliphatic polyester component and can be formed into a nonwoven fabric by thermal bonding. It is preferable that the melting point of the resin containing polyacetal as a main component is lower by 10 to 20° C. than the melting point of the resin containing polylactic acid as a main component. Owing to this, stable thermal bonding processing can be realized without using any other hotmelt fiber, and also a polyacetal layer is formed on a surface of polylactic acid to provide new features of appropriate hydrolysis resistance, chemical resistance, friction and abrasion resistance and the like. Conventional thermal bonding using a hotmelt fiber occasionally has problems in hydrolysis resistance and chemical resistance. In the present invention, such problems do not occur because the polyacetal layer acts also as a thermal bonding layer. It is possible to use a hotmelt fiber, but the use thereof is significantly limited because polyacetal has a disadvantage of having poor adhesiveness with other resins.

According to the present invention, by use of a multilayer composite fiber comprising a resin containing polylactic acid as a main component and a resin containing polyacetal as a main component, a thermally bonded nonwoven fabric having splendid adhesion strength and chemical resistance is obtained.

BEST MODE FOR CARRYING OUT THE INVENTION

Hereinafter, the present invention will be described in detail.

The present invention is directed to a multilayer composite fiber, comprising a resin containing polylactic acid as a main component and a resin containing polyacetal as a main component, wherein the components both form continuous layers in an axial direction of the fiber, and the resin containing polyacetal as a main component has a melting point which is lower by 10 to 20° C. than the melting point of the resin containing polylactic acid as a main component.

In the present invention, polylactic acid (PLA) refers to a polymer containing either only L-lactic acid, only D-lactic acid or a mixture of L-lactic acid and D-lactic acid as a main structural component, or a mixture of such polymers, but may contain a copolymerizable component other than lactic acid. Examples of such other monomer units include cyclic lactones such as c-caprolactone and the like; α-oxyacids such as α-hydroxyisobutylic acid, α-hydroxyvaleric acid and the like; glycol compounds such as ethylene glycol, propylene glycol, 1,4-butanediol and the like; and dicarboxylic acids such as succinic acid, oxalic acid, adipic acid, sebacic acid and the like. Among these, glycols and cyclic lactones are preferable.

As a polymerization method for producing PLA, any known polymerization method is usable. For example, direct polymerization from lactic acid, ring-opening polymerization via lactide, or the like is usable. According to the ring-opening polymerization, L-lactide or even a copolymerizable component (comonomer or oligomer) is ring-opening-polymerized in the presence of a catalyst. The resultant polymer is purified by re-precipitation when necessary, and thus PLA is obtained.

The molecular weight or molecular weight distribution of PLA is not specifically limited, but the number average molecular weight thereof is preferably 10,000 or greater, and more preferably 50,000 or greater.

The melting point of PLA is not specifically limited, but is preferably 160° C. or higher and more preferably 165° C. or higher.

In the present invention, the polyacetal may be a homopolymer and/or copolymer commercially available in general, and is preferably a copolymer of 100 parts by weight of trioxane and 5.0 to 30 parts by weight (more preferably 5 to 20 parts by weight) of one or at least two types of cyclic former and/or cyclic ether.

An oxyalkylene unit in the copolymer is preferably an oxyethylene unit, an oxypropylene unit or the like. The content of the oxyalkylene unit is preferably 5 to 30% by weight, and more preferably 5 to 20% by weight.

When the content is less than 5% by weight, the melting point is excessively high, and so a sufficient difference in the melting point from the polylactic acid may not be obtained. By contrast, when the content is more than 30% by weight, the melting point is excessively low, and so heat resistance and even chemical resistance may be spoiled.

In the present invention, examples of the polyacetal include copolymers containing formaldehyde or a trimer or a tetramer thereof (trioxane or tetraoxane), and an oxyalkylene unit structure produced from cyclic ether having a carbon number of 2 to 8 such as ethylene oxide, epichlorohydrin, 1,3-dioxolane, 1,3-dioxepane, 1,3,5-trioxepane, formal of glycol, formal of diglycol or the like. In the present invention, the copolymer encompasses two-component copolymers and also multi-component copolymers. For example, a copolymer having a branched or crosslinked structure introduced into a main chain as a result of copolymerization of glydicylethers is preferably usable. Moreover, a block copolymer having a block structure other than an oxymethylene unit and an oxyalkylene unit, or a graft polymer, and a wide range of other copolymers are usable.

In the present invention, the melting point of the resin containing polyacetal as a main component is preferably lower by 10 to 100° C., and more preferably 10 to 20° C., than the melting point of the resin containing polylactic acid as a main component. When the melting point of the resin containing polyacetal as a main component is lower by 10 to 100° C. than the melting point of the resin containing polylactic acid as a main component, a preferable result is provided that the adhesiveness between the resin containing polyacetal as a main component and the resin containing polylactic acid as a main component is good.

To the polylactic acid and the polyacetal used in the present invention, a known additive and/or filler may be added in a range in which the original object of the present invention is not spoiled. Usable additives include, for example, crystal nucleators, antioxidants, plasticizers, matting agents, foaming agents, lubricants, releasing agents, antistatic agents, ultraviolet absorbers, photostabilizers, heat stabilizers, deodorants, flame retarders, sliding agents, perfumes, antibacterial agents, and the like. Usable fillers include, for example, glass fiber, talc, mica, calcium carbonate, potassium titanate, whisker, and the like. In addition, a pigment or a dye may be added to obtain a finish of a desired color tone. Also, a transesterification catalyst, any of various monomers, a coupling agent, a terminus processing agent, any of other resins, wood flour, starch or the like may be added to cause denaturing.

The present invention is directed to a multilayer composite fiber, in which a resin containing polylactic acid as a main component and a resin containing polyacetal as a main component both form continuous layers in an axial direction of the fiber. According to an example of a method for forming continuous layers in an axial direction of the fiber, at least two types of starting material polymers are spun using such a nozzle that forms one filament of fiber. A fiber obtained in this manner is referred to as a composite fiber.

The composite fiber is classified into a bimetal type composite fiber in which the starting material polymers are bonded to each other and a core-sheath type composite fiber in which one type of polymer is enclosed by the other type of polymer. The composite fiber is also available in a multi-core type, a multi-valve type or a multilayer type, which are produced based on the bimetal type or core-sheath type composite fiber.

The core-sheath type composite fiber according to the present invention is obtained by a conventionally known melt spinning method. The core-sheath type composite fiber may include a plurality of core components or may have a deformed cross-section. A part of the core component may be present on a surface of the fiber.

The polylactic acid-based composite fiber according to the present invention may be used as it is as a multifilament or a monofilament, or may be formed into a staple fiber to be used as, for example, a spun yarn. Such types of fiber as they are, or such types of fiber combined with a fiber comprising a fiber thermoplastic resin composition which includes a resin containing polylactic acid as a main component and/or a resin containing polyacetal as a main component, may be subjected to second processing.

The second processing mainly results in provision of a nonwoven fabric. As a processing method also, known methods are usable. A spun bond method, a needle punch method, a melt blow method or the like is preferably usable. It is desirable that the fibers are thermally bonded in the end, utilizing the features of the core-sheath type fibers. According to the present invention, the fibers may be processed into textile, knitted item, braid, lace, mesh or the like as well as nonwoven fabric. The present invention also encompasses forming a high order composite fiber by thermally bonding the composite fibers, or by thermally bonding the composite fiber with any of various molded item formed of polyacetal or a thermoplastic resin composition containing aliphatic polyester represented by polylactic acid.

EXAMPLES

Hereinafter, the present invention will be described specifically by way of examples. The present invention is not limited to the following examples and may be embodied in any other form without departing from the gist of the present invention.

Example 1

Comparative example 1

The materials, the measuring method of the melting point, the bonding method, the curling method, and the criteria for success/failure determination which were used in the example and the comparative example will be shown below. The materials shown in Table 1 were used. The fibers formed of the components shown in Table 2 were melt-spun in the state where the ratio of the core and sheath components was 50% by weight, and the resultant fibers were rolled to be four times larger so as to have a size of 5 dtex. Using the obtained multilayer composite fibers, the following tests were performed. The results are shown in Table 2.

<Measurement of the Melting Point>

The temperature was raised from 30° C. to 210° C. at a rate of 10° C./min., and the peak melting temperature was measured by differential scanning calorimetry (DSC).

<Bonding Method>

The multilayer composite fibers shown in the sections of the "example" and the "comparative example" were each cut into a length of 10 cm. The obtained fibers were put on an iron plate so as to cross each other, and sandwiched between the iron plate and another iron plate. The fibers in this state were thermally bonded to each other for a prescribed time at a prescribed pressure using a hydraulic hot-press pre-heated to each temperature shown in Table 1. After the processing, the adhesion state of each crossing part was visually checked.

<Solvent Resistance>

A nonwoven fabric obtained by the adhesion test was immersed in acetone for a whole day and night, and the adhesion state in a swollen state caused by acetone was visually checked.

<Check on the Continuous Layer in an Axial Direction of the Fiber>

In order to determine whether polylactic acid and polyacetal both formed continuous layers in an axial direction of the fiber, the fiber was cut and the cross-section was visually checked. In Example 1, it was confirmed that the components both formed continuous layers in the axial direction of the fiber.

TABLE 1

| | | Name (abbreviated form) | Melting point [C. °] |
|---|---|---|---|
| Core | Polylactic acid | PLA | 170 |
| Sheath | Polyacetal (1) | POM-1 | 155 |
| | Polyacetal (2) | POM-2 | 165 |
| | Polyacetal (3) | POM-3 | 130 |
| Adhesive component | Polyester-based hotmelt adhesive fiber | HM | 110 |

The chemical structural formulas of polyacetal (1) and polyacetal (2) mentioned above are as follows.

$$[—CH_2O—]_n[—CH_2CH_2O—]_m$$

Polyacetal (1) and polyacetal (2) are different in the content of $[—CH_2CH_2O—]$. The content in polyacetal (1) is 7%, and the content in polyacetal (2) is 10%.

TABLE 2

| | Example 1 | Comparative example 1 |
|---|---|---|
| Core | PLA | PLA |
| Sheath | POM-1 | POM-2 |
| Adhesive component | — | — |
| Melting point difference from the core (° C.) | 15 | 5 |
| Adhesion test (° C.) | 160 | 170 |
| Adhesion state | Good | ×Both core and sheath were melted |
| Acetone immersion test | Good | — |

By use of a multilayer composite fiber comprising a resin containing polylactic acid as a main component and a resin containing polyacetal as a main component, theresin containing polyacetal as a main component having a specific difference in themelting point from the resin containing polylactic acid as a main component, a thermallybonded nonwoven fabric having splendid adhesion strength and chemical resistance is obtained.

The invention claimed is:

1. A multilayer composite fiber, comprising a resin containing polylactic acid as a main component and a resin containing polyacetal as a main component, wherein the components both form continuous layers in an axial direction of the fiber, and the resin containing polyacetal as a main component has a melting point which is lower by 10 to 20° C. than the melting point of the resin containing polylactic acid as a main component, wherein the polyacetal is a copolymer of 100 parts by weight of trioxane and 5 to 20 parts by weight of (i) one or more types of cyclic formal or (ii) one or more types of cyclic ether, wherein the polyacetal contains 5 to 7% by weight of an oxyalkylene unit comprised of an oxyethylene unit or an oxypropylene unit, wherein the polylactic acid has a melting point from 165° C. to 170° C., wherein the polyacetal has a melting point from 150° C. to 160° C., and wherein the resin containing polylactic acid as a main component is used as a core, and the resin containing; polyacetal as a main component is used as a sheath.

2. A nonwoven fabric obtained by thermal bonding of the multilayer composite fibers according to claim 1.

3. A nonwoven fabric obtained by mixing the multilayer composite fiber according to any one of claim 1 with a fiber comprising a resin containing at least one of polylactic acid as a main component and a resin containing polyacetal as a main component, and then thermally bonding the fibers.

* * * * *